US007219482B2

(12) United States Patent
Stemmle

(10) Patent No.: US 7,219,482 B2
(45) Date of Patent: May 22, 2007

(54) METHOD FOR FOLDING DOCUMENTS FOR USE IN WINDOWED ENVELOPES

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 11/491,827

(22) Filed: Jul. 24, 2006

(65) Prior Publication Data

US 2006/0254216 A1 Nov. 16, 2006

Related U.S. Application Data

(62) Division of application No. 10/914,533, filed on Aug. 9, 2004, now Pat. No. 7,104,034.

(51) Int. Cl.
*B65B 57/00* (2006.01)
*B43M 3/04* (2006.01)

(52) U.S. Cl. ..... 53/429; 53/117; 53/493; 53/284.3

(58) Field of Classification Search ..... 53/284.3, 53/117, 429, 430, 460, 467, 569
See application file for complete search history.

(56) References Cited

U.S. PATENT DOCUMENTS 4,034,210 A * 7/1977 Hill et al. ..... 235/487
4,517,650 A 5/1985 Gomes et al. ..... 364/478

(Continued)

FOREIGN PATENT DOCUMENTS

EP 0498515 A 8/1992

(Continued)

*Primary Examiner*—Stephen F. Gerrity
(74) *Attorney, Agent, or Firm*—Brian A. Collins; Angelo N. Chaclas

(57) ABSTRACT

A method and system for selecting fold lines on a sheet to be inserted into a windowed envelope includes scanning the windowed envelope with a scanner to determine the location of the window on the envelope. The location of a data block on an insert to be inserted into the windowed envelope is also determined. The position of one or more of the fold lines on the sheet to be inserted is determined such that a data block printed in the determined location on the sheet will appear behind the envelope window when the sheet is folded in accordance with the determined fold line pattern and inserted into the windowed envelope. The efficiency and flexibility of the system can be enhanced by providing an operator with possible standard and nonstandard fold patterns that will enable proper insertion of the folded sheet into the envelope. In such case, when the sheet is folded with the selected fold pattern and inserted into the envelope, the required data block information will appear behind the appropriate envelope window. The paper handling equipment adjustments for the selected fold type and proper loading of the insert materials into the insert feeders can be communicated to the operator or used to automatically adjust the folding mechanism for the selected fold pattern. Additionally template information can be generated by the system to provide the operator with information on the proper location for the address block information on the sheet in order to position the address information behind the window in the envelope for a selected standard fold type.

13 Claims, 5 Drawing Sheets

U.S. PATENT DOCUMENTS 4,525,788 A 6/1985 Gottlieb et al. ..... 364/478
4,527,468 A 7/1985 Piotroski ..... 101/2
4,745,346 A 5/1988 Muller ..... 318/685
4,862,386 A * 8/1989 Axelrod et al. ..... 715/507
5,339,603 A * 8/1994 Gombault et al. ..... 53/429
5,561,963 A * 10/1996 Sytema et al. ..... 53/55
5,640,835 A * 6/1997 Muscoplat ..... 53/569
5,680,742 A * 10/1997 Hidding ..... 53/411
5,683,338 A * 11/1997 Krasuski et al. ..... 493/23
5,897,733 A * 4/1999 Stevens ..... 156/227
6,412,255 B2 * 7/2002 Hidding et al. ..... 53/460
6,425,223 B1 7/2002 Miller et al. ..... 53/381.6

FOREIGN PATENT DOCUMENTS

FR 2717715 A1 * 9/1995
WO WO 98/24563 A * 6/1998

* cited by examiner

METHOD FOR FOLDING DOCUMENTS FOR USE IN WINDOWED ENVELOPES

RELATED APPLICATIONS

This application is a division of U.S. patent application Ser. No. 10/914,533, filed Aug. 9, 2004, now U.S. Pat. No. 7,104,034, which is hereby incorporated by reference.

FIELD OF THE INVENTION

The present invention relates to a method for folding documents for use in envelopes having transparent windows through which blocks of data/information is viewable.

BACKGROUND OF THE INVENTION

Paper handling systems frequently include both folder subsystems and inserter subsystems, although each of these subsystems can be a separate stand-alone system. These systems usually require a high degree of knowledge and skill on the part of the operator to obtain an appropriate folding pattern for insert material. When the folded material is to be inserted into a windowed envelope, the fold pattern is more critical and may be difficult to implement.

When creating an insert for a windowed envelope, the operator must determine exactly where to locate the frame or frames containing the data blocks of information to be located behind window or windows on the envelope. This requires considerable skill while creating the mailpiece, in order to get the various data blocks in exactly the correct position to appear behind the envelope windows when the document is folded and inserted into the envelope. Moreover, the situation can be further complicated when the material to be inserted is pre-printed without careful regard to the locations of the envelope windows.

In typical situations where windowed envelopes are employed, the operator must select the correct type of fold. Typical folds include C-folds, Z-folds, half-folds or double folds. The operator must set the folding adjustments on the equipment, such as the end-stop positions for fold plates and positions for deflector plates. This process may require multiple iterations in order to ensure that the data block frames, such as the address frames, on the envelope contents are properly positioned behind the windows when inserted into the envelope. This process requires the operator to have appropriate knowledge of the system, and often takes several attempts by trial and error method until the operator gets the fold type and equipment adjustments correct. This set-up procedure degrades equipment overall efficiency because of the time required for the operator to setup and the increased time to complete a particular paper-handling job. In some instances, an operator may not be able to make the required adjustments, requiring a more skilled operator or service technician to set up the adjustments for a particular mail processing job. This may further delay and increase the cost of running the mail processing job.

The problem is further complicated since there is no standard location for envelope windows. Envelope windows can be located in almost any position on the face or back of the envelope. Additionally, the envelope may include multiple windows. For example, an envelope may have a window for a recipient address data block, a return or sender address data block and, in some instances, a window for other needed information on both the front and the back of the envelope.

SUMMARY OF THE INVENTION

The present method simplifies the paper handling equipment setup by simplifying or eliminating of set-up decisions that an operator needs to make and implement to properly run a mail processing job.

The invention enhances the flexibility and efficiency of paper handling equipment by providing the operator with assistance on how to set up and run a mail-processing job. This assistance can include instructions on how to create the material to be inserted into the windowed envelope and how it might be folded. This facilitates getting data block information properly located on an insert sheet and positioned behind the appropriate envelope window. This is particularly useful where the material has been pre-printed without careful regard to the location of the envelope windows or where the envelope has multiple windows.

A method for folding sheets to be inserted into a windowed envelope is disclosed. The method includes the step of capturing an image of the windowed envelope with an imaging device such as a scanner to determine the location of the window on the envelope. Next, the location of a data block, such as a mailing or return address, on a sheet/document to be inserted into the windowed envelope is determined. The position of one or more of the fold lines on the sheet/document to be inserted is also determined such that the data block printed in the determined location on the sheet/document appears behind the envelope window when the sheet is folded and inserted into the windowed envelope.

In accordance with a feature of the present invention, a sheet fold patterns is determined from a plurality of sheet fold patterns, each of which would result in a data block printed in the determined location on said sheet will appear behind the envelope window when the insert sheet is folded into any of the determined fold patterns and inserted into the enveloped. In accordance with another feature of the present invention, the plurality of sheet fold patterns include both standard and non-standard fold patterns for the insert sheet such that a data block location on said sheet will appear behind the envelope window when the said sheet is folded in accordance with any of the determined fold line pattern and inserted into the envelope.

In accordance with yet a further feature of the present invention, the paper handling equipment adjustments are determined for the selected fold type and communicated to the operator or used to automatically adjust a folding mechanism to fold the sheet along the determined one or more fold lines. The communications can include a touch screen display may be used for the selection of the fold pattern and also may be used for the selection of the data block location on a sheet to be created and used in a mail processing job.

BRIEF DESCRIPTION OF THE DRAWINGS

Reference is now made to the various figures wherein like reference numerals designate similar items in the various figures and in which.

DETAILED DESCRIPTION OF THE PREFERRED EMBODIMENT

Figure 1:
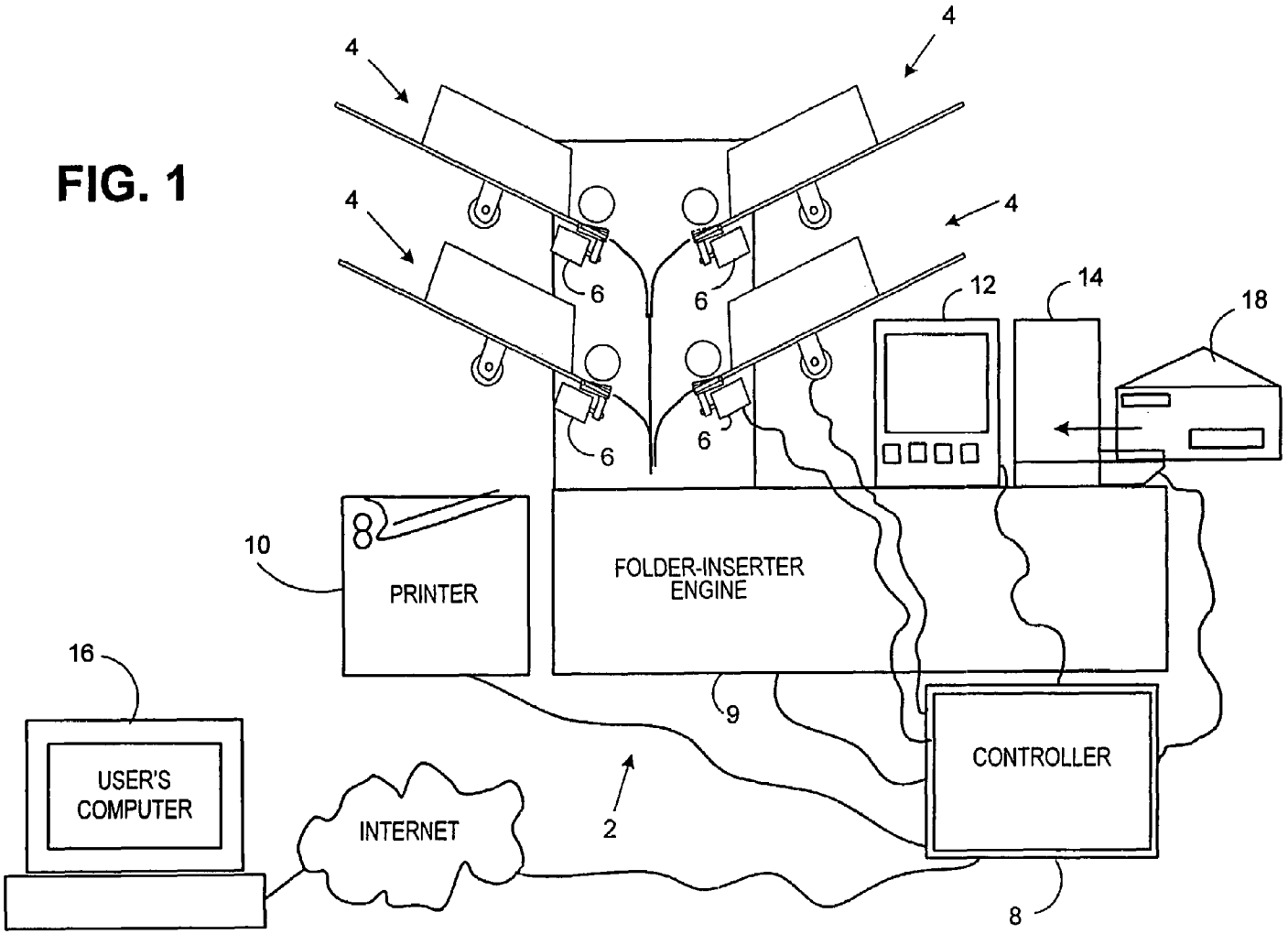
FIG. 1 is a block diagram of a system embodying the present invention.

The following is an overview of the method for selecting fold types and the fold line locations. This method can be employed to help create insert material and also to compensate for mis-positioning a data block to be windowed, such as the address frame on an address-bearing insert. For a mail-handling job in which the data block of the mailpiece insert has already been created, the operator indicates the location of a data block, such as address information on a sample insert, for example using a conventional highlighter marker. The operator then inserts this highlighted sheet into a scanning system, which scans the sheet and locates the data block bearing portion. The scanner is adapted with means for reading the specific wavelength of the highlighter marker and distinguishing this image from the rest of the images on the page. The same process is used in connection with other data block areas of the sheet, which must be located behind particular windows in the envelope, such as the return address. The particular scanning technology and process employed is not critical to the present invention. Any scanning system may be used that provides the necessary information. In one embodiment, the sheet may be scanned and the image displayed on a touch screen display. The operator may indicate the location of the address block on the sheet image by touching the screen at the points associated with the location of the address block. The operator also inserts the windowed envelope into the scanner to determine the exact location of a window(s) on the envelope. With this information, the system determines how the insert must be folded to ensure that the data block, such as a mailing address, return address and/or any other data block information, appears behind the appropriate window of the envelope.

Where the data block bearing insert sheet has not yet been created, the system may provide the operator with information as to where the data blocks should be located on the insert sheet for the selected fold pattern. By having the exact location of the various windows on the envelope from the scanning process, and the specific selected fold pattern desired, the system provides the operator with information as to the precise location for each of the various data blocks, such as sender address, recipient address and other windowed information to be printed on the insert materials.

The system may also determine for the selected fold pattern and the specific paper handling equipment how the stack of data-bearing and additional inserts must be loaded into the feeders and folders (face up or face down, top of sheet toward the front or the rear of the tray, etc.) and communicate this information to the operator via the user interface. The system may communicate to the operator the folding sub-system settings and the other adjustments or controls relevant to the proper folding of the material. The system may automatically adjust the equipment set-up parameters to determined values to implement the selected folding pattern where the system includes actuators or other means. The commercially available Pitney Bowes Inc. Model DI 200, Model DI 350 and Model DI 400 are examples of inserter systems having automatic adjustment of the folding mechanism. In making the adjustment, the Models 350 and 400 use a stepper motor and lead screw arrangement to move an end stop mechanism to the correct distance from the fold rollers. The Model 200 uses a servo motor controlled roller drive arrangement. In making the adjustment, the servomotor stops the roller rotation at a measured time from the detection of the sheet lead edge passing a sensor to initiate a fold. The stopped rollers are then reversed to cause the sheet to be driven toward the fold rollers.

The system may determine non-standard fold line patterns for the insert to compensate for errors in the location of the data blocks of information to cause the data block to appear behind envelope windows. In some situations, the folded insert will be different from the standard fold types. In a standard fold the sheet is folded into multiple panels that are approximately of equal area. Variation in the panel area can exist and the allowable variation of the panel area may be established by the operator or established at the time of equipment manufacture or of equipment set-up. For a standard fold type, when the document is folded and inserted into the envelope, each of the multiple panels will have approximately an equal dimension in a direction that is perpendicular to the envelope flap line.

For example, for tri-folding a standard 8.5×11" sheet, each panel of the folded sheet will be approximately 8.5×3.67" in area if the sheet is folded using a standard fold type. This applies to both C-folded and Z folded sheets. For half-folding of the same sheet, each panel in a standard fold will be approximately 8.5"×5.5". For non-standard folds, the area of the folded panels may be substantially different in width dimension from the standard fold panels. For example, a non-standard tri-fold might have two of the three panels at 8.5"×3.9", and the third panel at 8.5×3.2". Such non-standard fold types can be used to adjust the position of an address block in the folded piece so that it appears behind a window when inserted in an envelope, whereas if the sheet were folded with standard (approximately equal area) panels, the address would not be located fully behind the window. It should be noted that there are limitations on the range of non-standard folds that can be used. Generally speaking the maximum area of the largest panel in a non-standard fold type must still fit inside the envelope with appropriate clearances between the folded sheet and the seams on the envelope. The extent to which such errors of data block location can be compensated for depends, in part, on the specific equipment and shape and size of the material to be folded and inserted into the windowed envelope, and the dimension of the envelope.

Reference is now made to FIG. 1. Paper handling equipment 2, such as a folder—inserter engine 9, includes variable thickness feeders 4. The variable thickness feeders 4 are adapted to feed different insert material to an accumulator station within the paper handling equipment 2 where the accumulated material is folded. Each of the variable thickness feeders 4 includes a gap adjustment mechanism 6. This enables the system through the setting of the gap between the feed mechanism and the retard mechanism to accommodate different thickness material.

The paper handling equipment 2 operates under control of a controller 8 which may be connected to the paper handling folder-inserter engine 9, the variable thickness feeders 4, a systems printer 10, a user interface 12 and a scanner 14. The user interface 12 may include an interactive touch screen display for the display of information and the selection of functions and the input of data. The user interface is a means of communicating with a user. Many different forms of communications and various arrangements for user communications may be employed as the user interface. The controller 8 may be connected to a user computer system 16, as for example via the internet, a local area network or other suitable communication system. The controller provides processing and control logic for the system. This logic, as is explained hereinafter, may include means for determining fold line patterns and data block location and dimensions. This controller functionality can be located in the various subsystems and may be a centralized or a distributed processing system. A mailpiece envelope 18 and various document sheets (not shown) are scanned by the scanner 14 as will be hereinafter explained. The scanning mechanism may be employed to provide information to the controller 8 and the information used in connection with the settings for a selected fold pattern. Scanner 14 if desired may also provide information concerning the external dimensions of the envelope and any document sheets scanned. The information concerning external envelope and document sheet dimensions may be employed in the equipment set-up process if needed for the particular equipment employed. This is when the information is required as part of the settings to run a mail-processing job. Any suitable scanner may be employed for the scanning of the windowed envelope and documents sheets.

Figure 2:
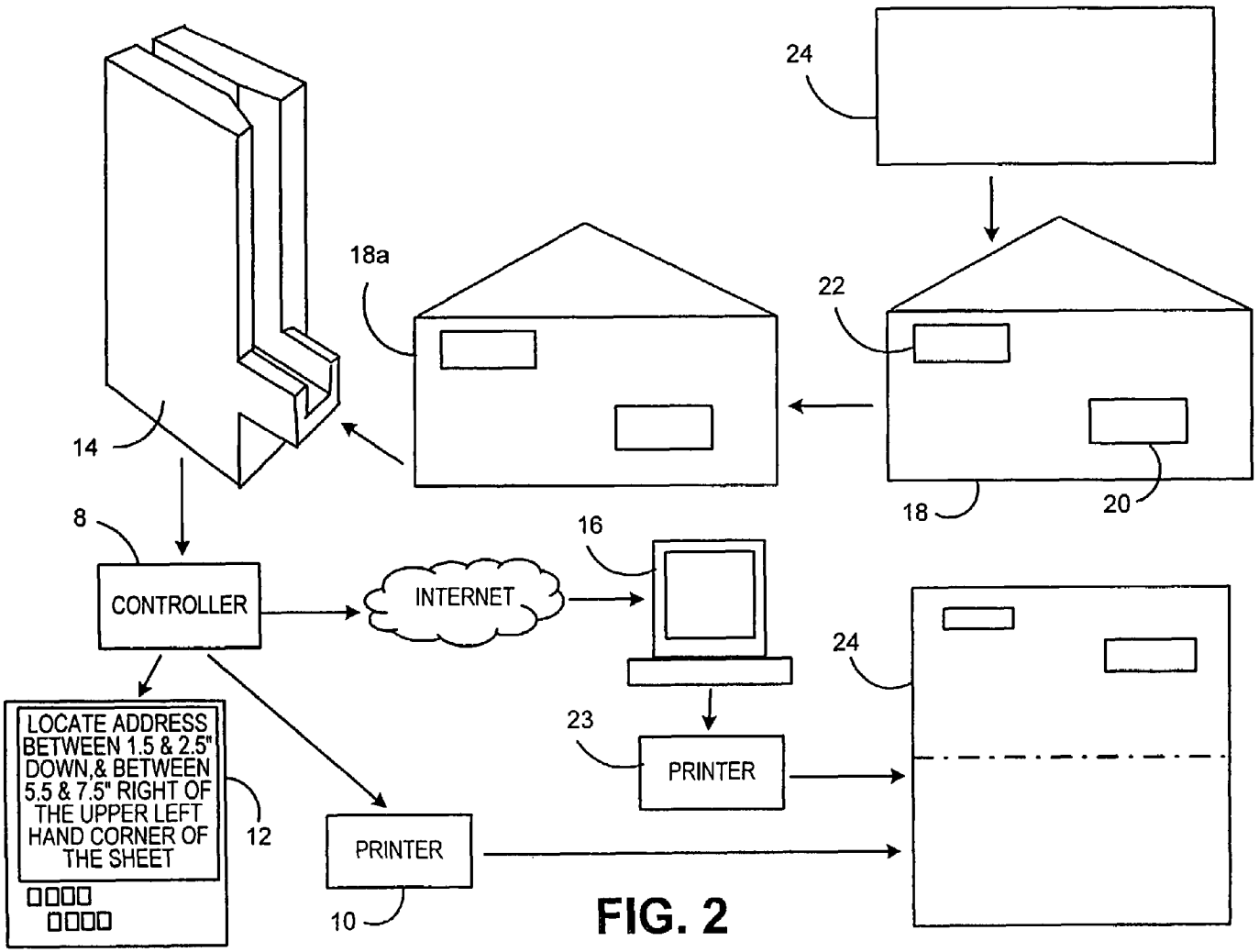
FIG. 2 is a diagrammatic representation of the process embodying the present invention.

Reference is now made to FIG. 2. Mailpiece item 18 is a windowed envelope shown with two windows 20 and 22. Window 20 is for addressee information printed on the contents and window 22 is for return or sender information. A card 24 may be inserted into the envelope 18 as shown at 18*a*. The inserted card 24 provides contrast between the surface of the windowed envelope and the frames of windows 20 and 22 sufficient for the scanner to detect the window locations. Other forms of image contrast enhancement can be employed, such as, a highlighter to change the color of the windowed portion of the envelope or the interior surface the envelope may be of a different color material. Alternatively, the scanner 14 may be of sufficient sensitivity without contrast enhancement to detect the location of the windows on the envelope surface, in which case, the step of inserting card 24 is not required.

The mailpiece item envelope 18*a* is inserted into the scanner 14 for scanning. The scanner detects the location of the windows on the envelope and provides the information to the controller 8. The controller 8 may communicate with the user in one or more of several different formats. The controller may communicate to the user interface 12 providing specific location information for a selected insert fold pattern for the various frames or data blocks of information. These are the data blocks that must appear behind the windowed portion of the envelope when the material is folded and inserted into the envelope. The information may be provided as an e-mail attachment sent to the user computer 16 or to a printer, such as printer 10. The printer 10, or a printer 23 associated with the user computer 16, prints a template or instruction-type document 24. Document 24 can be printed to contain detailed instructions as to where to position the various data blocks or to be a template of the insert. The same process for other data blocks may be employed for any other windowed portions of the envelope.

The system of communication with the operator can be used for other types of information critical to proper folding including placement/loading of the materials to minimize operator errors. These errors are often due to the variation in how insert materials can be loaded into the equipment. The information may include for the selected fold pattern, the orientation in the feeder of the insert material to be folded such as: face up or face down, top of the sheet or item in toward the direction of the feed path or out from the direction of the feed path; and, for bound material, bound edge in or bound edge out, bound edge to the left side or the right side.

Figure 3:
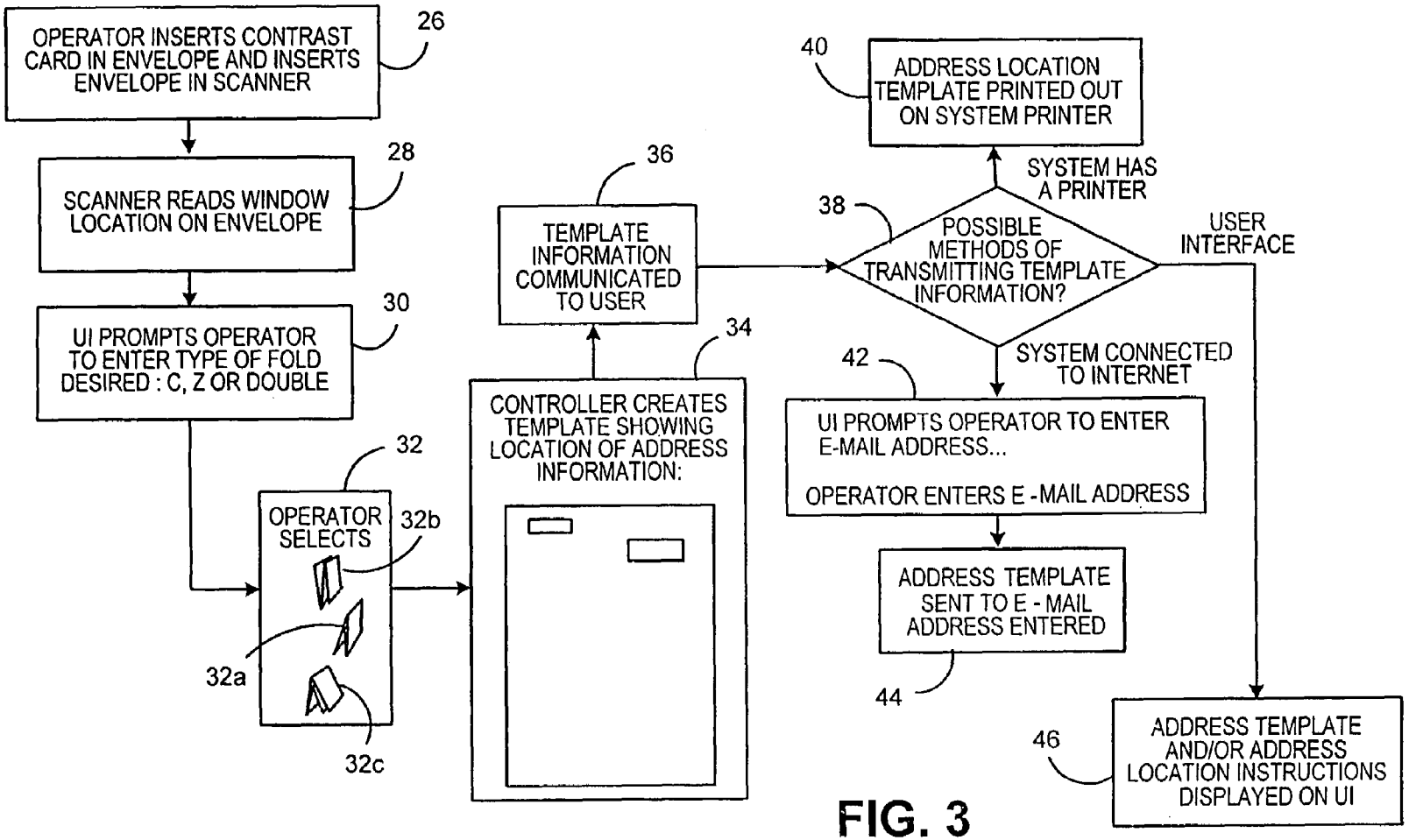
FIG. 3 is a flow chart of the system shown in FIGS. 1 and 2.

Reference is now made to FIG. 3, showing a flowchart of the operation of the system shown in FIGS. 1 and 2. The operator inserts the contrast card in the envelope (if that is required for the particular scanner) and inserts the envelope into the scanner at 26. The scanner 14 detects the window location on the envelope at 28 and via the user interface prompts the operator to enter the type of fold desired at 30. The fold can be a C-fold, as shown at 32*a*, a Z-fold as shown at 32*b*, or a double-fold as shown at 32*c*. It should be understood that other standard folds such as cross-folds, half-folds and the like may also be displayed and can be employed. The operator selects a type of fold at 32 from one of these standard folds. The system controller then creates a template showing the location of the data blocks, here, address information, on the data block-bearing sheet to be folded and inserted into the windowed envelope at 34. The template information is communicated to the user at 36. A decision is made at 38 as to how the information is to be communicated to the user. Some or all of the communication alternatives can be employed, or selected by the operator as the preferred method of communicating information. The address location template can be printed on the system printer as shown at 40. The user interface can prompt the operator to enter e-mail address information at 42 and the address template is sent to the e-mail address 44. As yet another alternative, the address template and/or address location instructions can be displayed on the user interface 16, as shown at 46. In the case where the system creates a template to tell the operator where to put the address information on the sheet, the operator must first select the preferred fold type. Given specific envelope dimensions and window locations, each sheet fold pattern will require a unique location for the data blocks of information on the sheet.

In the above manner, the scanner determines the location of the windows on the envelope. The user interface requests the operator to enter the preferred type of fold and the controller determines the correct location of the data block information on the insert sheet to be created. This ensures that the data block and any other necessary data block information is behind the appropriate window when the sheet is folded and inserted into the envelope. The controller creates the template needed for the creation of a series of the insert sheets to be placed into the feeder. The controller conveys the template information to the operator in one of the three noted matters, along with any other information such as the orientation of the insert material in the feeder.

Figure 4:
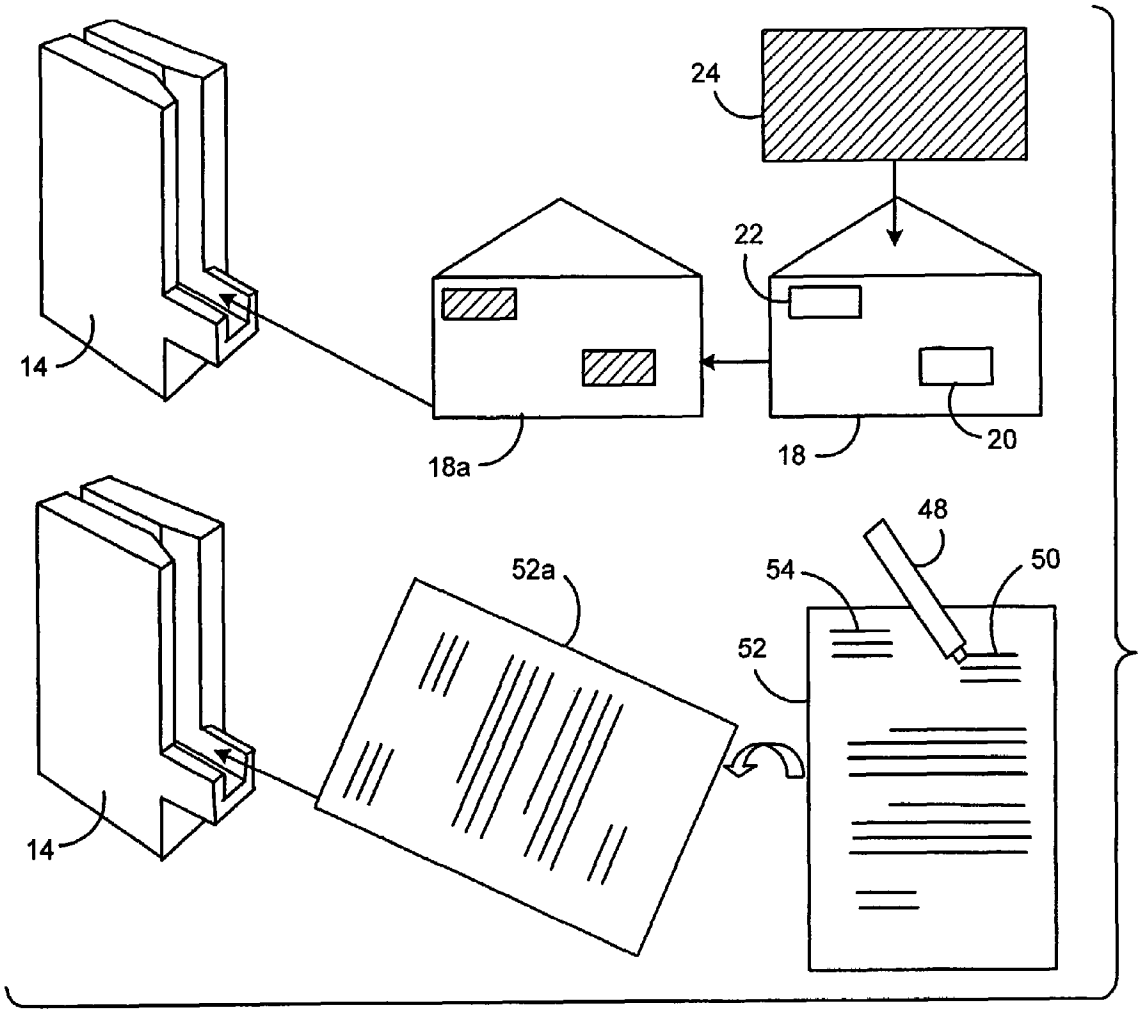
FIG. 4 is a diagrammatic representation of an embodiment of the present invention where the insert material has been pre-printed; and, FIG. 5 is a flow chart of the system shown in FIG. 4.

Reference is now made to FIG. 4. As previously explained the operator may insert the contrasting image density card 24 into the windowed envelope 18 and the envelope 18*a* containing the contrasting image density card is inserted into the scanner 14. The operator then uses a highlighter marker, fluorescent ink marker, or other suitable marking device 48 to shade the area 50 on insert sheet 52 so that the scanner can read the location of the addressee information. The return information or sender address block 54 may also be highlighted so that the scanner can detect its location on the sheet. The sheet 52 is then appropriately oriented and inserted into the scanner 14. If the insert sheet 52 had other data blocks of information to be displayed through a third windowed portion of envelope 18, not shown, the area would also be highlighted by highlighter 48. Alternately, the scanned image on the sheet may be displayed on a touch screen user interface, and the operator my indicate the location of the address information by touching the screen in the appropriate places when prompted to do so by the user interface.

Figure 5:
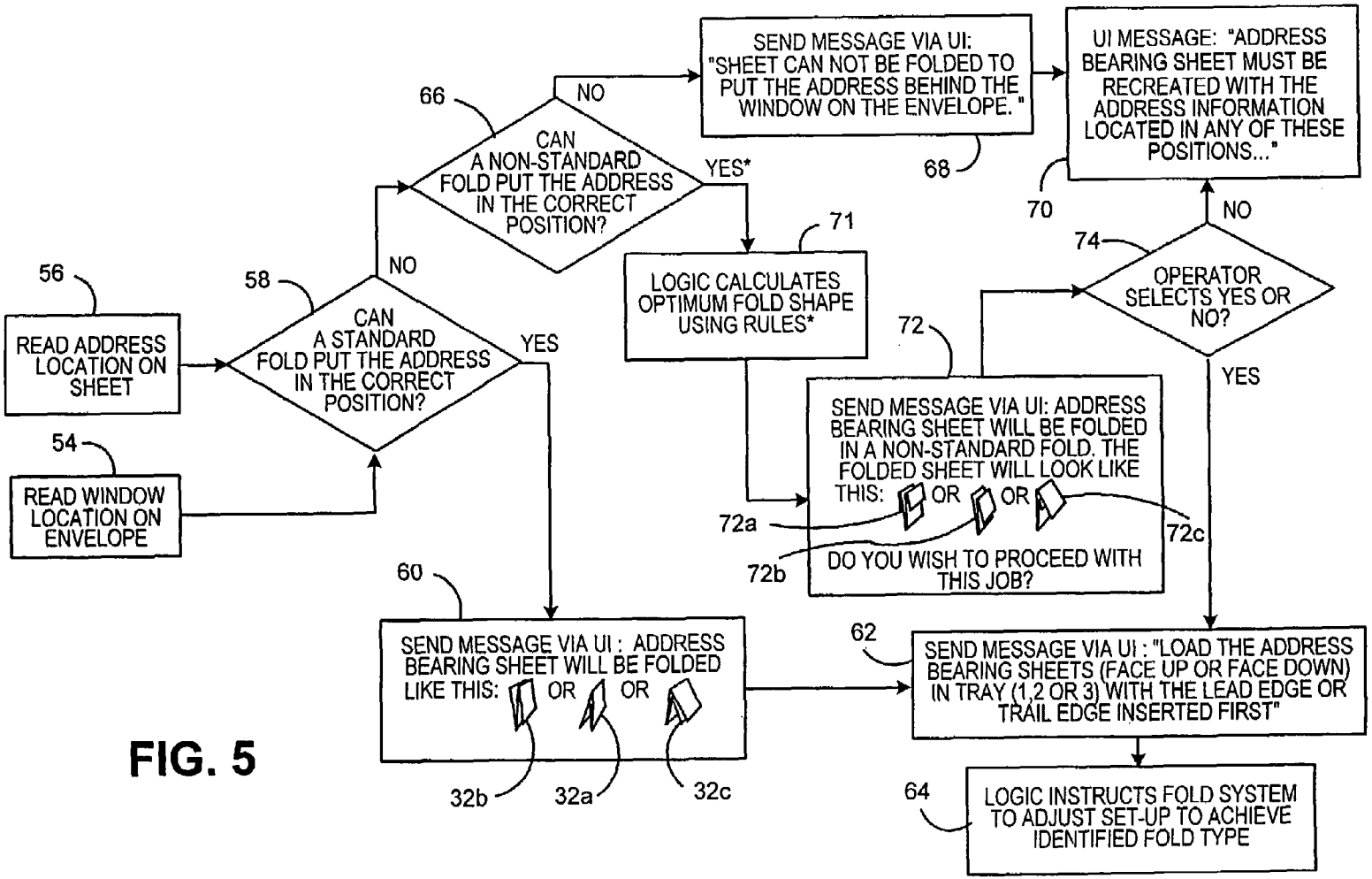

Reference is now made to FIG. 5. The scanner 14 detects the location of the windows on the envelope at 54 and the scanner 14 detects the of the data block information on the insert sheet to be folded at 56. The information to be detected includes any of the information intended to be displayed through the envelope windows when the folded sheet is inserted into the envelope. A determination is made at 58 if a standard fold can put the appropriate data block information in the correct position with respect to the windowed envelope. If this is the case, a message is sent at 60 via the user interface to the operator. The information provides the various standard folds that can be employed with the particular data block information locations on the pre-printed insert sheet and the envelope window locations. These may include the C-fold shown at 32*a*, the Z-fold shown at 32*b* and the double-fold shown at 32*c*.

The controller selects the particular a type fold which will put the address information behind the window of the envelope at 60 and a message is sent to the user via the user interface at 62 as to how to load the particular material into the various feeders, envelope feeders, etc., and may further communicate the various settings and adjustments for the folder-inserter engine 9. The information conveyed may be of the type previously noted. The controller 8 may alternatively instruct the equipment with the capability to adjust the equipment set-up to achieve the identified fold type for the particular material inserted at 64. In this manner, having measured both the location of the windows on the envelope and the location of the data blocks or frames for the information to appear behind the windows on the insert sheet, the controller 8 determines which type of fold can be employed, thereby eliminating the requirement for the operator to figure it out. And, for the selected fold pattern, the controller 8 determines how to properly load the data block-bearing sheets into the feeder in order to ensure that the necessary information is positioned behind the appropriate window on the envelope when the folded sheet is inserted.

Referring back to decision block 58, if a standard fold cannot put the needed information behind the appropriate envelope window, a determination is made at 66 whether a non-standard fold can achieve the appropriate positioning of the data block information behind the appropriate envelope window. If this cannot be achieved, a message is sent at 68 via the user interface that the sheet cannot be folded in such a way that the appropriate information will appear behind the appropriate window on the envelope. The user interface message at 70 advises the operator that the insert sheet bearing the data block information intended to be located behind the window must be re-created with the data block information located in any of specific positions that are communicated to the operator as noted in the flow chart shown in FIG. 3.

If a non-standard fold can put the data block information in the correct position, the controller 8 at 71 calculates the fold shape using pre-determined criteria. These pre-determined criteria or rules will include information, for example, that the outside dimension of the folded sheet cannot be smaller than a particular measured height and width to ensure that the data block, such as an address, cannot shift, as for example, during transit, to a position that would obscure the data block information behind the non-windowed portion of the envelope. Also, the outside dimension of the folded sheet cannot be larger than the dimensions of the envelope. The folded sheet must fit within the envelope with the appropriate clearances to insure both that the flap can be closed and sealed, and the sheet inside the envelope cannot shift enough to move a portion of the address field from behind the window. If multiple types of folds, for example, a C-fold or a Z-fold can be used to accomplish putting the information behind the appropriate window in the correct location, the system may select the type that results in the most reliable systems operation. The extent to which a non-standard, non-symmetrical type fold is acceptable may also be included.

A message is sent via the user interface at 72 that the data block-bearing sheet must be folded in a non-standard fold that might look, as for example, like those shown at 72*a*, 72*b*, and 72*c*. These are various forms of non-symmetrical folded material, which nonetheless achieve the results of having the appropriate data block information positioned behind the appropriate envelope window and which also meet the pre-determined criteria or rules established for the system. For example, the folds do not result in an inserted item that may shift during transit or does not have a fold pattern with more than a specific number of fold lines, and the like. At decision box 74, the operator then determines whether to proceed with the non-standard fold. If a decision is made at 74 to proceed with the fold, the process branches to 62 and the process continues with the loading of the material, as instructed, into the equipment. If, on the other hand, a decision is made not to proceed with the non-standard fold, the process continues at 70 with the insert sheet being re-created, and sending template information to the operator to instruct in the proper location of the address block information. The template information may be of the type shown in block 34 of FIG. 3.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended Claims.

What is claimed is:

1. A method for folding a sheet for insertion into an envelope having a window, comprising the steps of:

capturing an image of the envelope to determine a location of a window on said envelope;

determining a location of a data block on a sheet to be inserted into said envelope;

determining the position of one or more fold lines on said sheet such that said data block will appear behind the window of said envelope; and folding said sheet in accordance with said one or more determined fold lines.

2. The method as defined in claim 1 wherein said data block is preprinted on said sheet and the step of determining said location of said data block is by scanning said sheet with a scanner to define an image of said data block.

3. The method as defined in claim 2 wherein said step of determining said location of said data block further includes the step of displaying an image of said data block on a touch screen display and selecting displayed points associated with the location of the displayed data block.

4. The method as defined in claim 1 wherein the step of determining the location of said window further includes determining the external dimensions of said window.

5. The method as defined in claim 1 wherein the determined position of one or more fold lines is selected from a plurality of sheet fold patterns.

6. The method as defined in claim 5 further including the step of communicating said plurality of sheet fold patterns to a user on a display which displays said plurality of sheet fold patterns.

7. The method as defined in claim 1 wherein said step of capturing an image of said envelope includes the steps of:

placing a contrast card into the envelope such that the contrast card is viewable through the window, scanning the envelope to obtain a high contrast image thereof, and calculating the location of the window from the high contrast image.

8. A method for folding a sheet to be inserted into a windowed envelope, comprising the steps of:

determining the external dimensions of said windowed envelope;

capturing an image of the windowed envelope to determine the location and dimensions of a window on said windowed envelope;

determining the location and dimensions of a text block on said sheet to be inserted into said windowed envelope;

determining a fold line pattern on said sheet Such that a text block printed in said location on said sheet will appear behind the window when said sheet is folded in accordance with said determined fold line pattern and inserted into said windowed envelope; and, folding said sheet in accordance with said determined fold line pattern.

9. The method as defined in claim 8 further including the step of automatically adjusting a folding mechanism to fold said sheet in accordance with said determined fold line pattern.

10. The method as defined in claim 8 further including the step of communicating to a user setting adjustments for a folding mechanism to fold said sheet in accordance with the determined fold line pattern when adjusted to said communicated setting adjustments.

11. The method as defined in claim 8 further including the step of communicating to a user the orientation of said sheet to be inserted into said folding mechanism and the setting adjustments for said folding mechanism to fold said sheet along said determined fold line pattern.

12. The method as defined in claim 8 further including the step of scanning the sheet to capture a scanned image of the text block and wherein said step of determining said location and dimensions of said text block further includes the step of displaying the image of said scanned text block on a touch screen display and selecting displayed points associated with the location of the displayed text block.

13. The method as defined in claim 8 wherein said step of capturing an image of said envelope includes the steps of:

placing a contrast card into the envelope such that the contrast card is viewable through the window, scanning the envelope to obtain a high contrast image thereof, and calculating the location of the window from the high contrast image.

* * * * *